US009338545B2

(12) United States Patent
Rubin

(10) Patent No.: US 9,338,545 B2
(45) Date of Patent: May 10, 2016

(54) ACOUSTIC WAVE CONDUCTOR FOR MOBILE DEVICES

(71) Applicant: Gregory Rubin, Woodland Hills, CA (US)

(72) Inventor: Gregory Rubin, Woodland Hills, CA (US)

( * ) Notice: Subject to any disclaimer, the term of this patent is extended or adjusted under 35 U.S.C. 154(b) by 0 days.

(21) Appl. No.: 14/564,871

(22) Filed: Dec. 9, 2014

(65) Prior Publication Data

US 2015/0245130 A1 Aug. 27, 2015

Related U.S. Application Data

(60) Provisional application No. 61/913,621, filed on Dec. 9, 2013.

(51) Int. Cl.
*H04R 1/20* (2006.01)
*H04R 1/34* (2006.01)

(52) U.S. Cl.
CPC ..... *H04R 1/342* (2013.01)

(58) Field of Classification Search
CPC ..... H04R 1/10; H04R 1/1091; H04R 1/342; H04R 2499/11
See application file for complete search history.

(56) References Cited

U.S. PATENT DOCUMENTS

2002/0048385 A1* 4/2002 Rosenberg ..... H04M 1/05 381/374
2013/0075889 A1* 3/2013 Pagaila ..... H01L 23/552 257/713
2015/0104027 A1* 4/2015 Mulumudi ..... H04R 1/46 381/67
2015/0136148 A1* 5/2015 Cheng ..... A61F 11/08 128/868

* cited by examiner

*Primary Examiner* — Tuan D Nguyen
(74) *Attorney, Agent, or Firm* — Edward Langer, Adv & Patent Attorney

(57) ABSTRACT

An acoustic wave conductor assembly for mitigation of harmful radiation inherent in a mobile device belonging to a user. The assembly includes an acoustic wave conductor designed ergonomically for insertion into the external auditory ear canal of the user's ear and connecting means between the acoustic wave conductor and the user's mobile device, such that the user is enabled to hear telephone conversations, but keep the mobile device at a safe distance from his head and all his vital tissues, wherein the assembly is simple, efficient, economical and effective.

6 Claims, 8 Drawing Sheets

ACOUSTIC WAVE CONDUCTOR FOR MOBILE DEVICES

FIELD OF THE INVENTION

The present invention generally relates to acoustic devices, and in particular to an acoustic wave conductor for mitigation of harmful radiation inherent in mobile devices.

BACKGROUND OF THE INVENTION

Based on new findings, the World Health Organization classifies cell phones as a potential cancer risk, much like exhaust from gasoline-powered vehicles and lead. For many people, it's just not practical or realistic to avoid cell phones altogether. And it may not be necessary, if one takes precautions for reducing exposure. The standard used by federal regulators may not be the best measure of safety, nor is it the best way to help concerned consumers reduce their exposure.

Moving a cell phone, or other mobile device, even an inch from the body can greatly reduce radiation exposure. Signal strength falls off as the square of the distance to the source. This means that if one doubles the distance to the source, which is from the cell phone to one's head, the signal strength would be four times less, since two squared is four. If one triples the distance, the signal strength would be nine times less, and so on.

In US Pat. App. No. 20110170730A1, "Safe In-Ear Earphones," Zhu discloses a safe in-ear earphone for radiation protection, comprises earplug heads, sound cavities, acoustic wave transmission channels, a main body, a conductor and a plug. The channels are set between the sound cavities and loudspeakers. The acoustic wave concentrated orifices are between the loudspeakers and the acoustic wave transmission channel assemblies of the loudspeakers. The acoustic wave concentrated orifices and the acoustic wave transmission channels are sealed to form sealed small boxes in the main body. The shape of acoustic wave concentrated orifices is inversely conical. The acoustic wave is transmitted to the two acoustic wave channels via the acoustic wave concentrated orifices and then is provided to the ears plugged by two earplugs to listen. The safe in-ear earphone is used for high frequency magnetic field and intense radiation communication device such as mobile phone.

The Federal Communications Commission (FCC) recommendations stipulate keeping a cellphone up to 2.5 cm away from the users head. The acoustic channel of the present invention provides for a separation of 5-6 cm, i.e., 2 times 2, or 4 times as safe.

1. information on cellphone radiation levels found on this website http://reviews.cnet.com./2719-6602 7-291-4.html
2. information from iphone manual found on this website (http//idownloadblog.com/2011/03/07/dont-hold-your-iphone-too-close-to-your-head-apple-says-so/)

Apple iPhone 4—Important Product Information Guide:

For optimal mobile device performance and to be sure that human exposure to RF energy does not exceed the FCC, IC, and European Union guidelines, always follow these instructions and precautions: When on a call using the built-in audio receiver in iPhone, hold iPhone with the dock connector pointed down toward your shoulder to increase separation from the antenna. When using iPhone near your body for voice calls or for wireless data transmission over a cellular network, keep iPhone at least 15 mm (5/8 inch) away from the body, and only use carrying cases , belt clips, or holders that do not have metal parts and that maintain at least 15 mm (⅝") separation between iPhone and the body.

Thus, it would be advantageous to provide an acoustic channel to be attached to a mobile device speaker that is simple, efficient, economical and effective, thereby enabling the user to hear telephone conversations, but keep the device at a safe distance from the head and all his vital tissues.

SUMMARY OF THE INVENTION

Accordingly, it is a principal object of the present invention to provide an acoustic wave conductor to be attached to a mobile device speaker, thus enabling the user to hear telephone conversations, but keep the device at a safe distance from the head and all the vital tissues of the user.

It is another principal object of the present invention to provide an acoustic wave conductor to be attached to a mobile device speaker that is simple, efficient, economical and effective It is one other principal object of the present invention to safely generate sound away from the head, like the secret service type plastic tube with air-headphone.

It is a further principal object of the present invention to enable the acoustic wave conductor to be attached with a "clip-on" attachment that can be adjustable depending on phone thickness.

An acoustic wave conductor assembly is provided for mitigation of harmful radiation inherent in a mobile device belonging to a user. The assembly includes an acoustic wave conductor designed ergonomically for insertion into the external auditory ear canal of the user's ear and connecting means between the acoustic wave conductor and the user's mobile device, such that the user is enabled to hear telephone conversations, but keep the mobile device at a safe distance from his head and all his vital tissues, wherein the assembly is simple, efficient, economical and effective.

There has thus been outlined, rather broadly, the more important features of the invention in order that the detailed description thereof that follows hereinafter may be better understood. Additional details and advantages of the invention will be set forth in the detailed description, and in part will be appreciated from the description, or may be learned by practice of the invention.

BRIEF DESCRIPTION OF THE DRAWINGS

In order to understand the invention and to see how it may be carried out in practice, a preferred embodiment will now be described, by way of a non-limiting example only, with reference to the accompanying drawings. In the drawings.

All the above and other characteristics and advantages of the invention will be further understood through the following illustrative and non-limiting description of preferred embodiments thereof.

DETAILED DESCRIPTION OF PREFERRED EMBODIMENTS

The principles and operation of a method and an apparatus according to the present invention may be better understood with reference to the drawings and the accompanying description, it being understood that these drawings are given for illustrative purposes only and are not meant to be limiting.

Figure 1:
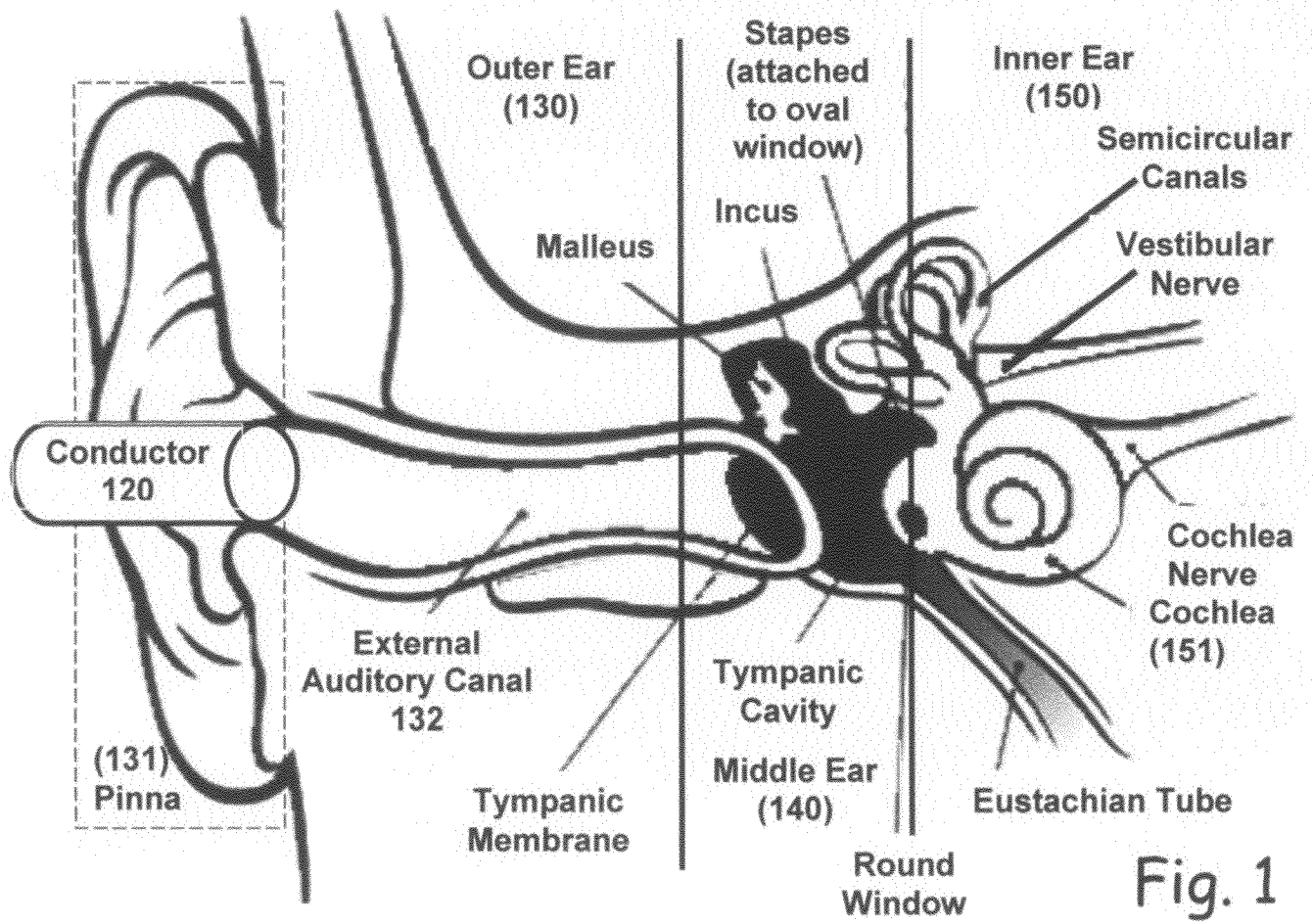
FIG. 1 is a schematic illustration of the acoustic conductor for mitigation of harmful radiation inherent in mobile devices shown inserted in the ear of a user, constructed according to the principles of the present invention.

FIG. 1 is a schematic illustration of the acoustic conductor for mitigation of harmful radiation inherent in mobile devices shown inserted in the ear of a user, constructed according to the principles of the present invention. The human ear is composed of three major sections: the outer ear 130, the middle ear 140 and the inner ear 150. Each section has a specific function in the hearing process. The path for conduction of acoustic sound waves to inner ear 150 begins from outer ear 130, through middle ear 140 and then conduction to inner ear 150 through bone conduction. Sound enters outer ear 130, which has two parts, the Pinna 131, or visible portion of the ear, and the external auditory canal 132. The acoustic wave conductor 120 of the present invention is shown inserted into the external auditory ear canal 132 of the user's ear. By such "hand-in-glove" insertion, ambient noise is excluded from being heard by the user, noise that would otherwise interfere with the voice of a remote caller or called party.

Earplug devices are meant to be worn fully inserted into one's ear. One needs to get the squishy tip to form a tight seal with all of the walls of the ear canal—"like a cork in a wine bottle." Without that proper seal, the transference of sound will suffer, especially the low frequencies, and too much outside noise will creep in.

Middle ear 140 consists of three tiny bones, or ossicles, that are suspended in an air-filled space. They connect the eardrum to inner ear 150, which is embedded in the skull. The ossicles function as a mechanical lever system that delivers sound from ear canal 132 to inner ear 150. Noise does not affect middle ear 140, unless there is an impact sound or pressure so great that it dislodges or fractures the ossicles.

In inner ear 150, the cochlea 151 is susceptible to damage from continued exposure to high-level noise. Cochlea 151 is a fluid-filled hydraulic system driven by the piston action of the last ossicle. The vibrating motion of the ossicle produces a wave motion in a membrane that runs the full length of cochlea 151. If the vibrations are fast, high-frequency sounds, the membrane has its greatest motion at the base of the cochlea near the vibrating ossicle. If the vibrations are slow, low-frequency sounds, the maximum membrane motion occurs at the tip of 151.

The primary function of Pinna 131 is to aid in sound source localization. The various ridges in Pinna 131 filter the signal at frequencies over 4000 Hz according to the direction of the sound. The resulting spectral variations allow the brain to determine the elevation of a sound and localize sounds in reference to our position.

Ear external auxiliary canal 132 can be modeled as a tube approximately 2.8 cm long that is closed at one end by the tympanic membrane. Unlike a rigid tube that has a sharp spike in amplitude at the resonant frequency, ear canal 132 has a wide resonance peak from approximately 2-5 kHz. Ear canal 132 is not rigid, nor is it a straight tube. Therefore damping is introduced, thereby altering the resonant frequency. Thus, ear canal 132 can raise the Sound Pressure Level (SPL) of the ear by up to 15 dB, which will amplify the incoming acoustic signal.

Figure 2:
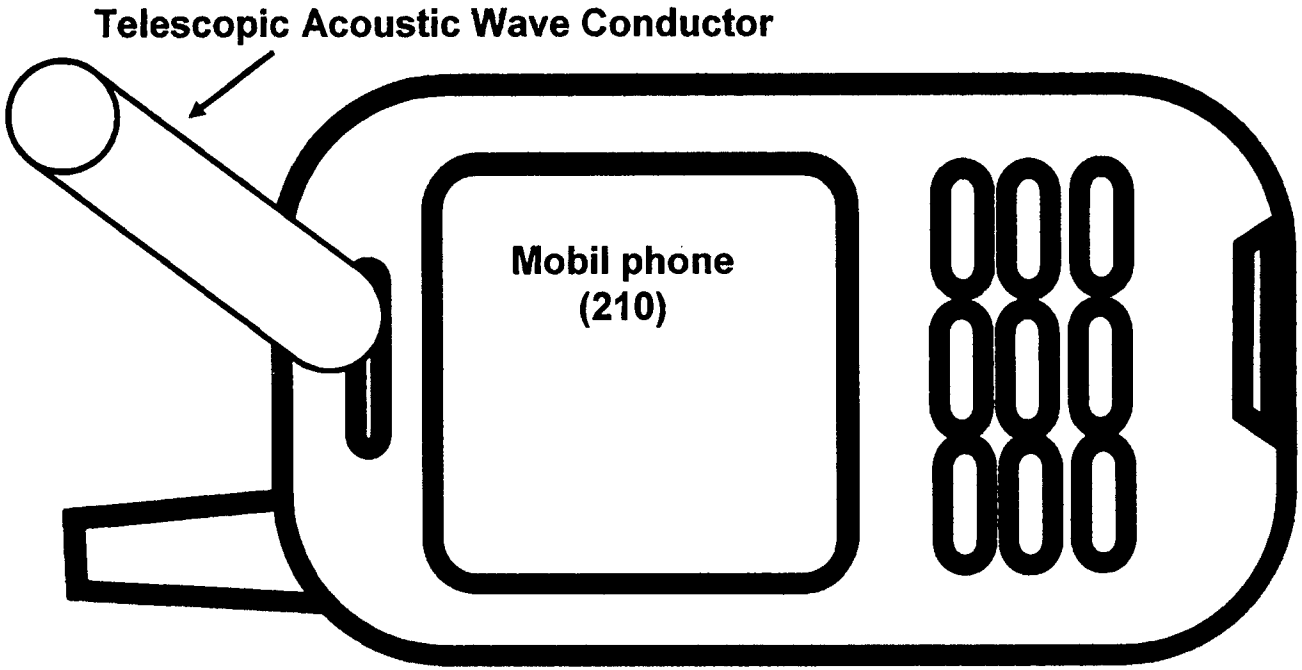
FIG. 2 is a schematic illustration of the acoustic conductor for mitigation of harmful radiation inherent in mobile devices shown attached to a mobile device, constructed according to the principles of the present invention.

FIG. 2 is a schematic illustration of the acoustic wave conductor 220 for mitigation of harmful radiation inherent in mobile devices shown attached to a mobile phone 210, which may be any mobile listening and or speaking device, such as iPod, Android, or wireless land phone handset, constructed according to the principles of the present invention. An acoustic wave conductor connector 215 is used to connect between acoustic wave conductor 220 and mobile phone 210. One form of exemplary connector is described with reference to FIG. 4 below. However, any satisfactory means of connection may be used, such as a magnet or simple spring clip. Acoustic wave conductor 220 can be plastic, metal or a composite and can preferably be "telescopic," i.e., extendable and retractable by the sliding of overlapping sections. The smaller end of acoustic wave conductor 220 is near mobile phone 210, to facilitate connection.

Figure 3:
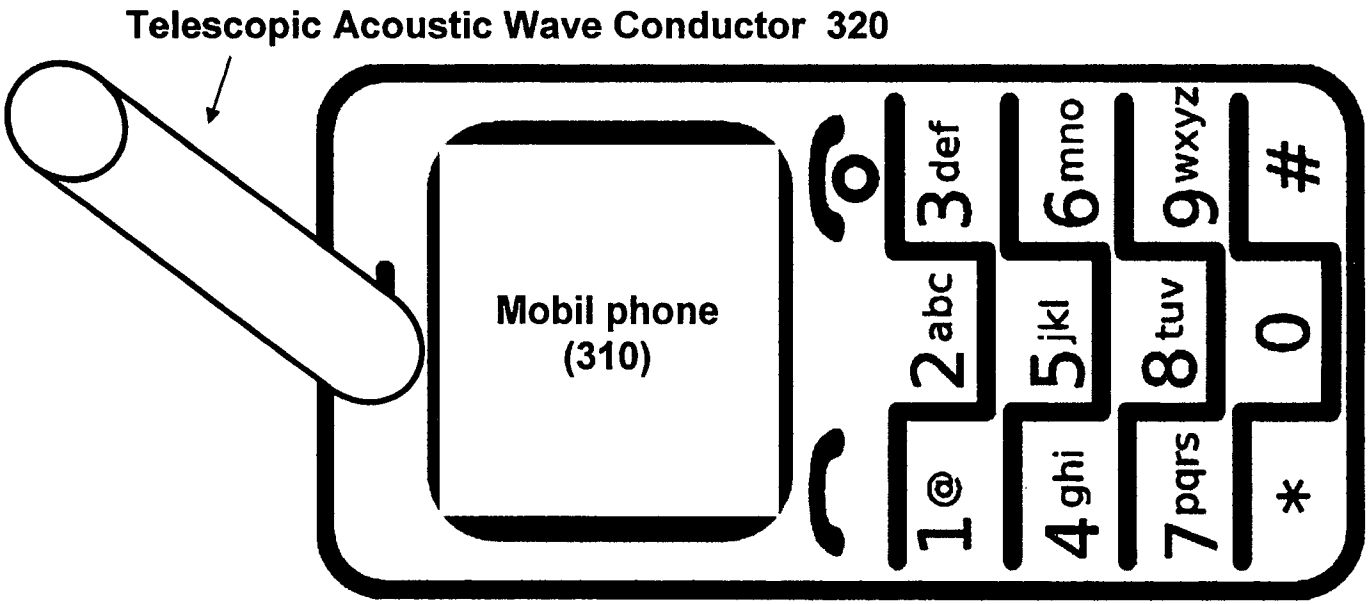
FIG. 3 is a photographic illustration of the acoustic conductor for mitigation of harmful radiation inherent in mobile devices, shown attached to a mobile device, constructed according to the principles of the present invention.

FIG. 3 is a photographic illustration of the acoustic wave conductor 320 for mitigation of harmful radiation inherent in mobile devices, shown attached to a mobile device 310, constructed according to the principles of the present invention.

Figure 4:
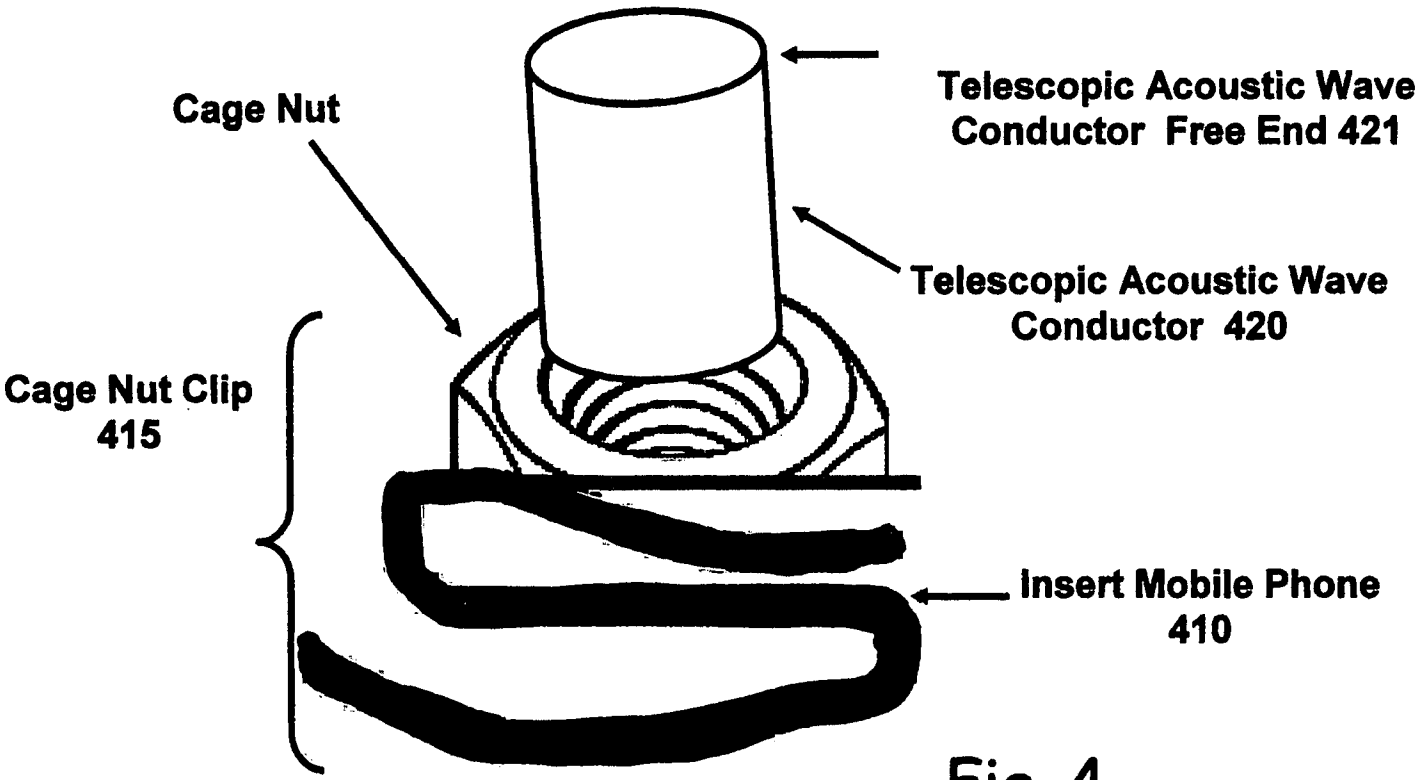
FIG. 4 shows photographic illustrations of exemplary means of connection between the acoustic conductor and the user's mobile device, constructed according to the principles of the present invention.

FIG. 4 shows photographic illustrations of exemplary means of connection between the acoustic conductor and the user's mobile device, constructed according to the principles of the present invention. In a preferred embodiment the acoustic wave conductor 420 is adapted to have a threaded end for securely being orthogonally screwed into a Spring India™ cage clip nut 415. The free end of the acoustic wave conductor 421 is designed to be inserted into the ear of a user. The clip portion of exemplary cage clip nut 415 is designed for secure insertion of the users mobile phone 410. Acoustic wave conductor 420 is shown extending through cage clip nut 415 into secure physical connection with the speaker of the user's mobile phone 410.

Optionally, acoustic wave conductor 420 could be connected to extend in the plane of the mobile phone and/or could "jack-knife" fold back against acoustic wave conductor 420, along with the threaded portion of cage clip nut 415, for stowing away more compactly.

Figure 5:
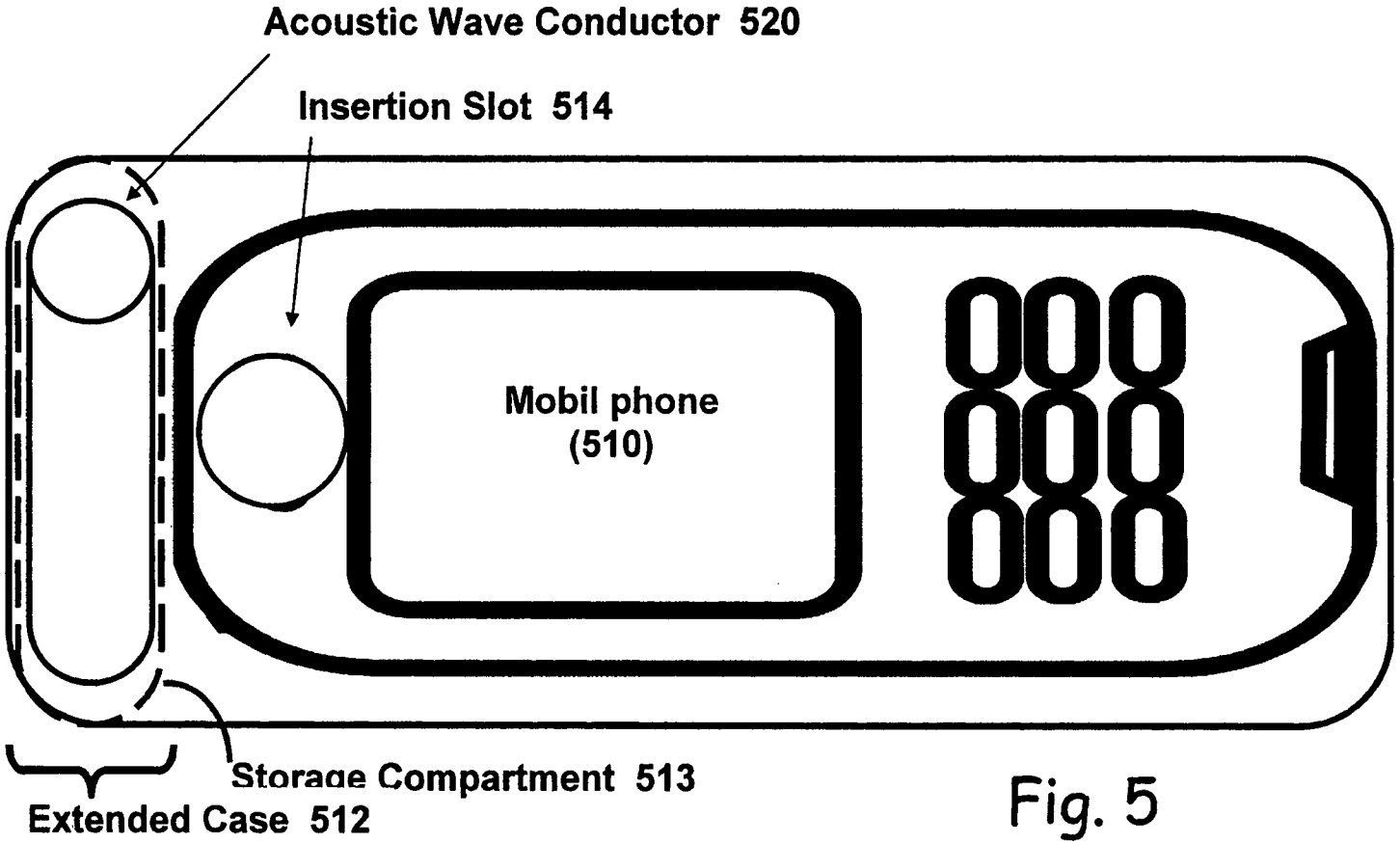
FIG. 5 is a schematic illustration of the acoustic conductor for mitigation of harmful radiation inherent in mobile devices provided with a phone case extension storage compartment for the acoustic conductor, constructed according to the principles of the present invention.

FIG. 5 is a schematic illustration of the acoustic conductor for mitigation of harmful radiation inherent in mobile devices provided with an extended case 512 housing a storage compartment 513 for the acoustic wave conductor 520 in mobile phone 510, constructed according to the principles of the present invention. An insertion slot 514 is shown on mobile phone 510, which mates with a key extension Not shown) on acoustic wave conductor 520 for guided connection.

Figure 6:
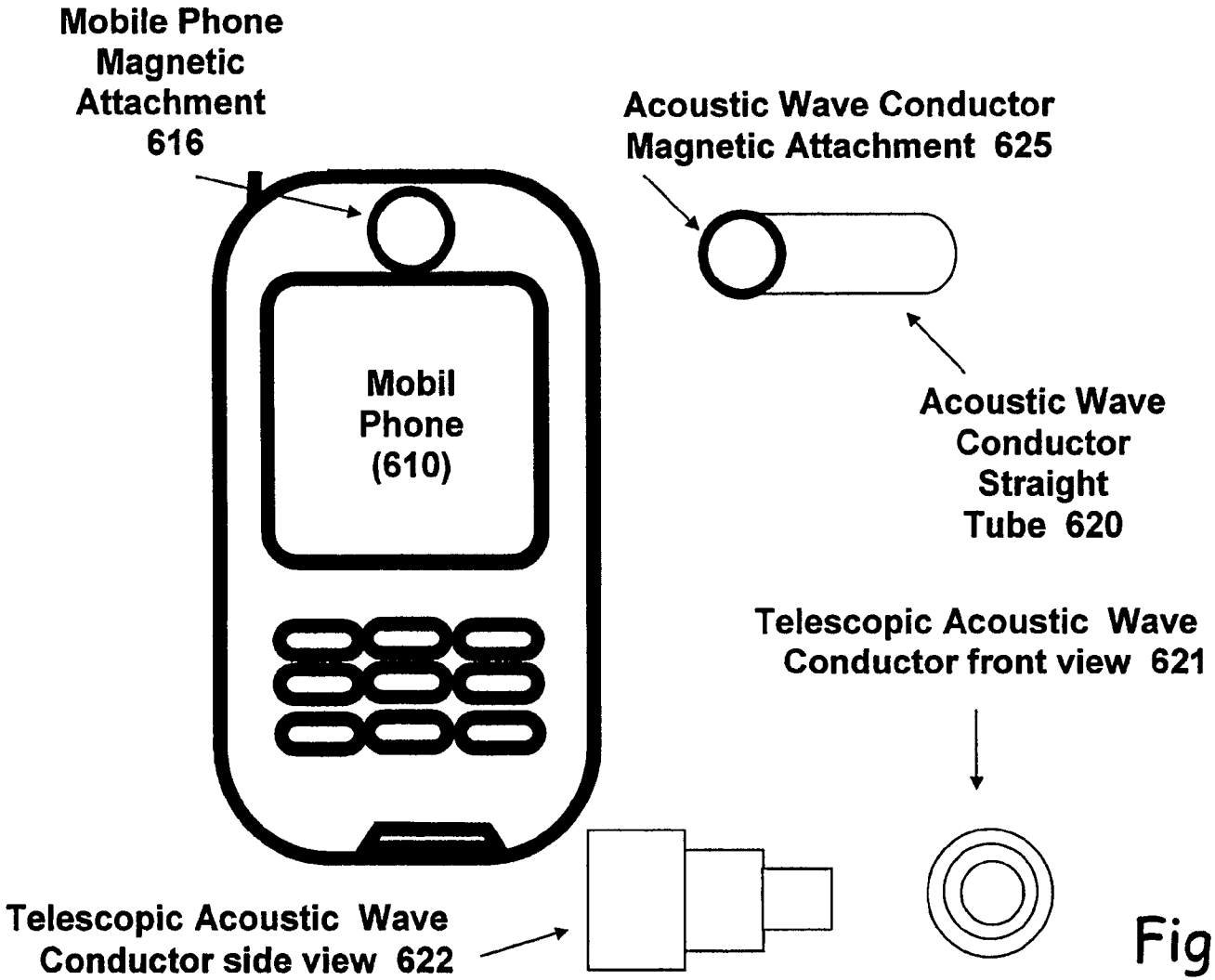
FIG. 6 is a schematic illustration of an exemplary magnetic means of connection between the acoustic conductor and the user's mobile device, constructed according to the principles of the present invention.

FIG. 6 is a schematic illustration of an exemplary magnetic means of connection between the acoustic wave conductor and the user's mobile phone 610, or other type of mobile device, constructed according to the principles of the present invention. As illustrated with reference to FIG. 2, the acoustiv c wave conductor may be a straight tube 620, or it may be telescopic as shown in front view 621 and side view 622. The attachment means may be provided by implementation of a mobile phone magnetic attachment 616 and an acoustic wave conductor magnetic attachment 626.

Figure 7:
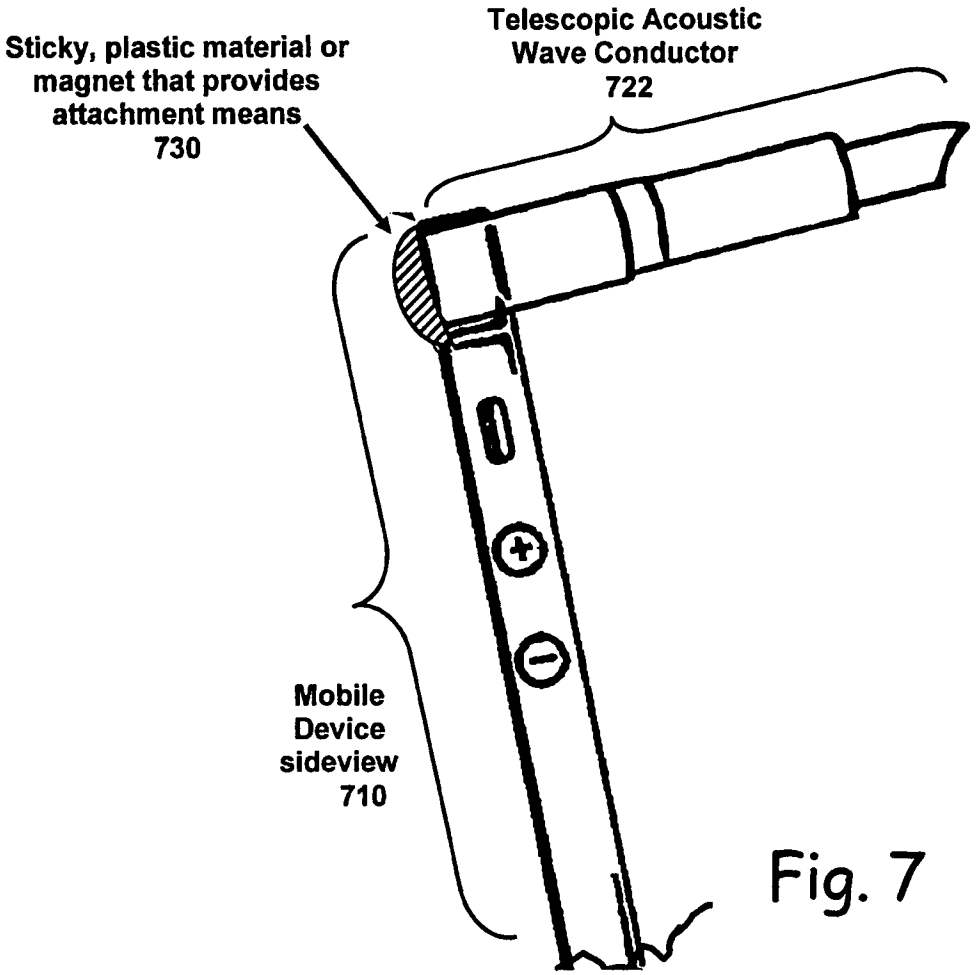
FIG. 7 is a schematic sideview illustration of exemplary attachment means between the acoustic conductor and the user's mobile device, constructed according to the principles of the present invention.

FIG. 7 is a schematic sideview illustration of exemplary attachment means 730 between the acoustic conductor 722 and the user's mobile device 710, constructed according to the principles of the present invention. Attachment means 730 is represented schematically as a hash-marked rounded feature circumscribing the rectangular intersection of the two elements 730, 722.

Figure 8:
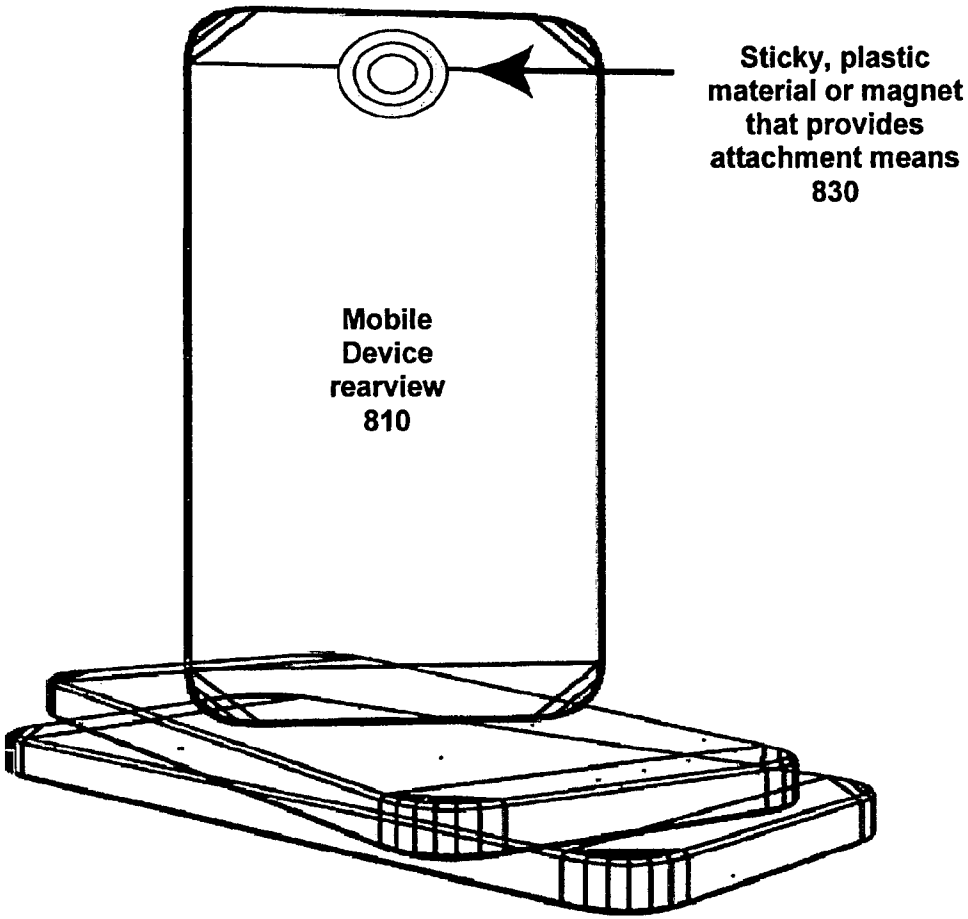
FIG. 8 is a schematic rearview illustration of exemplary attachment means between the acoustic conductor and the user's mobile device, constructed according to the principles of the present invention.

FIG. 8 is a schematic rearview illustration of exemplary attachment means 830 between the acoustic conductor and the user's mobile device 810, constructed according to the principles of the present invention.

Having described the invention with regard to certain specific embodiments thereof, it is to be understood that the description is not meant as a limitation, since further embodiments and modifications will now become apparent to those skilled in the art, and it is intended to cover such modifications as fall within the scope of the appended claims.

I claim:

1. An acoustic wave conductor assembly for mitigation of harmful radiation inherent in a mobile device belonging to a user, the assembly comprising:

an acoustic wave conductor having a tube-shaped channel free of any hearing impediment, said conductor being designed ergonomically for insertion into the external auditory ear canal of the user's ear; and connecting means between the acoustic wave conductor and the user's mobile device, wherein the connecting means is at least one of an add-on sticky material or a magnet, such that the user is enabled to hear telephone conversations, but keep the mobile device at a safe distance from his head and all his vital tissues, and wherein the assembly is simple, efficient, economical and effective.

2. The acoustic wave conductor assembly of claim 1, further comprising an extension for a case within which the mobile device is seated, said case extension providing a storage means for the acoustic wave conductor.

3. The acoustic wave conductor assembly of claim 1, wherein the size of the sticky material depends on the size of the user's mobile device and a cover of the mobile device.

4. The acoustic wave conductor assembly of claim 1, wherein the size of the add-on sticky material depends on the position of the user's mobile device and a cover of the mobile device.

5. The acoustic wave conductor assembly of claim 1, wherein the size of the add-on sticky material depends on the thickness of the user's mobile device and a cover of the mobile device.

6. The acoustic wave conductor assembly of claim 1, wherein the size of the add-on sticky material depends on the shape of the user's mobile device and a cover of the mobile device.

* * * * *